United States Patent [19]

Van Doorn

[11] Patent Number: 4,779,309

[45] Date of Patent: Oct. 25, 1988

[54] ROLLER GIN

[75] Inventor: Donald W. Van Doorn, Columbus, Ga.

[73] Assignee: Lummus Industries, Inc., Columbus, Ga.

[21] Appl. No.: 66,568

[22] Filed: Jun. 26, 1987

[51] Int. Cl.[4] ..... D01B 1/06

[52] U.S. Cl. ..... 19/50; 19/43

[58] Field of Search ..... 19/49, 50, 51, 52, 53, 19/54, 43

[56] References Cited

U.S. PATENT DOCUMENTS 633,994 10/1899 Graves ..... 19/50

*Primary Examiner*—Louis K. Rimrodt

*Attorney, Agent, or Firm*—Jennings, Carter, Thompson & Veal

[57] ABSTRACT

A roller gin capable of producing lint substantially free of linter fibers utilizes a wall construction to prevent the seed from contacting the ginning roll, a ginning slot in the wall through which an airflow draws the fibers. A ginning roll adjacent the slot on the opposite side of the wall grasps the fibers along a nip point formed between the roll and wall proximal the slot and urges the fibers along a path on one side of the wall while the seeds are urged along a divergent path on the other side of the wall.

17 Claims, 4 Drawing Sheets seed cotton in
10
11
13
12
16
23
18
14
22
"A"
17
20
air in
19
21
24
seed out
lint & air out

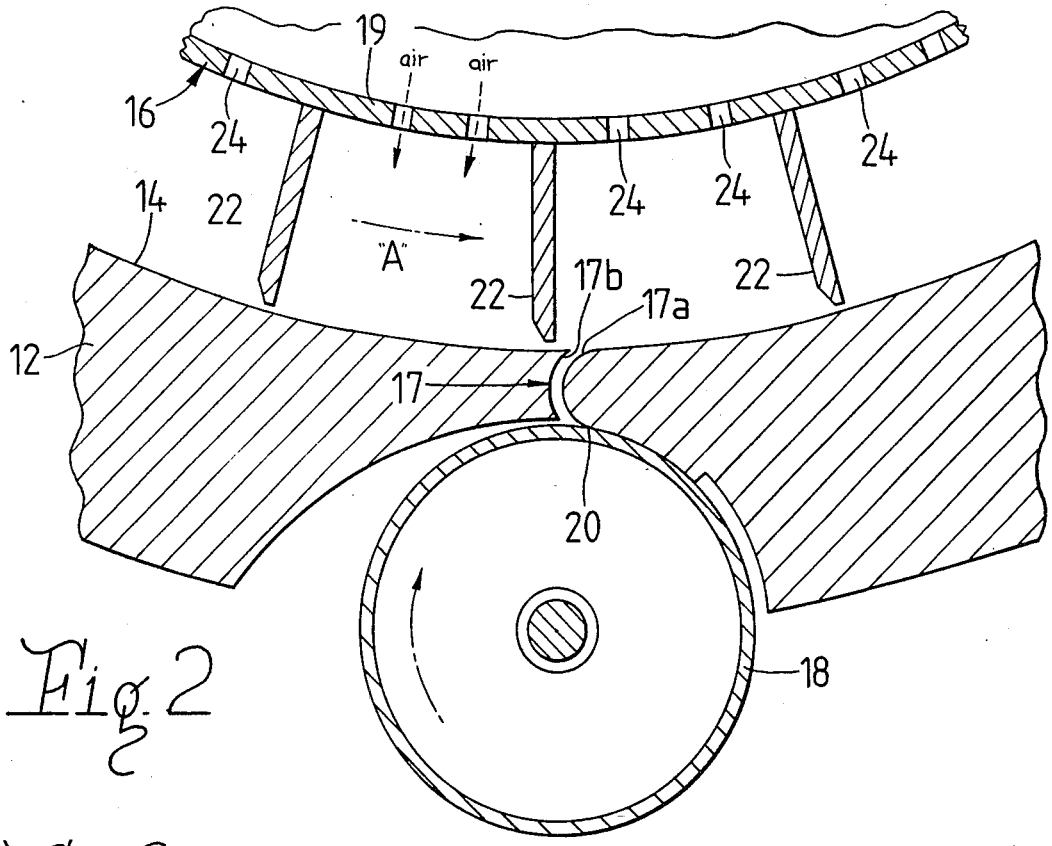
Fig. 2
Fig. 3
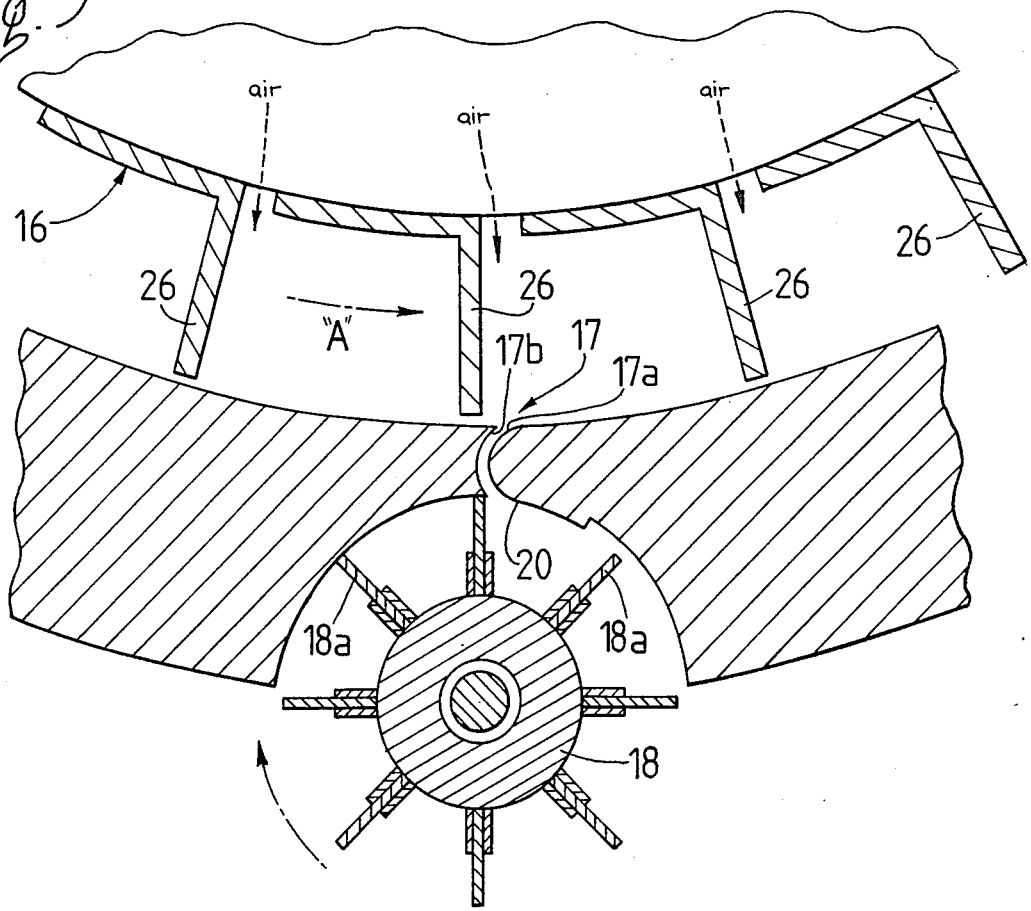

ROLLER GIN

FIELD OF THE INVENTION

The present invention relates to the field of cotton ginning apparatus and methods. More particularly the present invention deals with ginning cotton having "fuzzy seeds" and the removal of the longer fibers without substantial amounts of linter fibers. More particularly the present invention relates to a roller ginning apparatus wherein the cotton seed does not contact the gin roller.

BACKGROUND OF THE INVENTION

The predominant method of ginning cotton today involves the use of disk-like toothed members rotating side by side with ribs between the spaced-apart disks. The seed cannot pass through the gaps between the ribs whereas the lint fibers pass through the gaps as the lint is impaled on the teeth of the disk-like members. This process inherently breaks an appreciable percentage of fibers, and furthermore, the tips of the teeth on the disk-like members remove some of the short linter fibers and cut into some of the seed coats, creating seed coat fragments with fibers attached to them which are very difficult to remove in the later cleaning processes.

Another method of ginning cotton employs a cylindrical roller covered with an animal hide, such as walrus, or fiber-impregnated rubber packing-like material. This roller is pressed against a stationary "knife". Seed cotton is dropped onto the surface of the roller and the cotton fibers are drawn between the roller surface and the stationary knife while the seed are stripped back by the nose of the stationary knifes. Thus the lint fibers pass under the stationary knife and the seeds are ejected over the top of stationary knife. In the latest technology, a rotary bladed or finned cylinder (rotary knife) assists in bringing the seed cotton to the pinch point between the stationary knife and the roller and in pulling the seed away from the pinch point.

The roller ginning process has certain advantages over the saw ginning process but is not fully adaptable. to ginning upland or fuzzy seed cotton. The advantages of the current roller gin processes over the saw gin processes over the saw gin process are that there is less fiber breakage and less "nepping" of the fibers. The disadvantage of the current roller ginning technology is the removal of some of the short linter fibers along with the desirable long fibers, and thus the lint contains a high percentage of short, undesirable fiber. Furthermore, on upland cotton, the current roller gin processes are even slower than they are in ginning extra long staple varieties of cotton that do not contain linter fibers.

New textile mill processes are also being introduced that are best exploited with more uniform fiber length, and less short fiber and neps in the fiber.

SUMMARY OF THE INVENTION

It is the object of the present invention to minimize seed damage in the ginning process.

Yet another object of the invention is to reduces stress and breakage of the cotton fibers during ginning.

Still another object of the invention is to provide lint fibers having more uniform length.

These objects and others are advantageously accomplished in the present invention through the use of a novel combination of elements wherein the see cotton does not contact the gin roller and a conventional "knife" or "saw" is not used. In the present invention, a stationary wall is disposed within the gin along the path of seed cotton input thereto. The wall has at least one slot therein formed transversely to the direction of travel of the seed cotton and having a width less than the minimum dimension of the cotton seed. Adjoining the slot is a member for urging seed cotton along the stationary wall past the slot. This member is preferably a vaned cylinder whose vanes pass the slot in the stationary wall at a distance less the diameter of the cotton seeds. The slot forms a passage through the wall to a ginning roll, or the like, mounted for rotation adjacent the wall. A sub-atmospheric pressure is maintained on the ginning roll side of the wall to draw air through the slot toward the ginning roll such that fibers from the seed cotton are drawn through the slot and engaged by the ginning roll. The wall thickness and slot contour are such that only fibers of a predetermined minimum length are engaged by the roll; therefore, all shorter fibers are left on the seed and a more uniform lint is produced. In some embodiments, a plurality of slots and ginning rolls are utilized to iteratively gin the seed cotton to assure that the desired fibers are removed.

BRIEF DESCRIPTION OF THE DRAWINGS

Apparatus embodying features of my invention are depicted in the accompanying drawings which form a portion of this application and wherein:

FIG. 2 is a partial sectional view showing the cooperation of the ginning roll, the slot, and one embodiment of the feed member;

FIG. 3 is a partial sectional view showing the cooperation of the ginning roll, the slot, and a second embodiment of the feed member;

DESCRIPTION OF THE PREFERRED EMBODIMENTS

Figure 1:
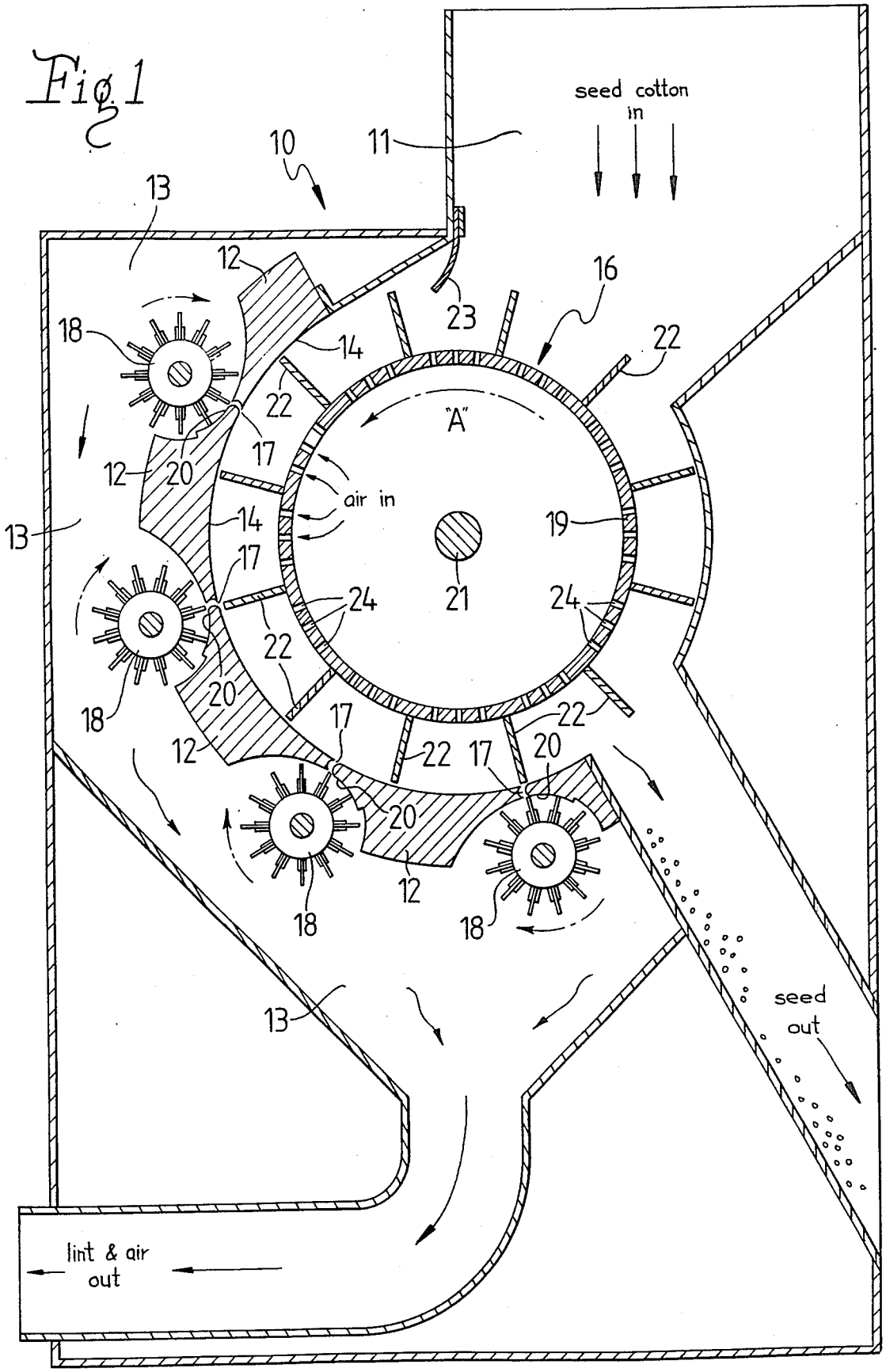
FIG. 1 is a sectional view taken transversely to axis of rotation of the feed member.

Referring to FIG. 1, the apparatus 10 is shown with a feed chute 11 for directing cotton from a conventional feeder (not shown) which may be of the type now used in conventional gins. A stationary wall 12 is connected to the lower end of the feed chute 11 and forms one side of a lint removal chamber 13. The wall 12 has an outer surface 14 which is curved to cooperate with the outside diameter of a rotationally driven finned member 16 which urges the cotton from the feeder chute 11 along the wall 12 past a slot 17 therein formed generally parallel to the axis of rotation of the finned member 16 and transverse to the path of the cotton. The slot 17 allows communication between the chamber 13 and the region adjoining the finned member 16. Internal of the chamber and mounted for rotation along an axis parallel to the length of the slot 17 is a ginning roll 18 which is urged against the interior of wall 12 adjoining the slot 17 creating a nip point or line 20, shown more clearly in FIG. 5, along the interior of the wall adjoining the slot. Sub-atmospheric pressure is maintained within the chamber 13 by conventional fan members as are commonly used in gins to entrain lint in an airflow and which are not shown. An airflow through the slot 17 is thus induced in the apparatus.

Again referring to FIG. 1, in this embodiment, a single finned member 16 urges the seed cotton along the surface 14 of wall 12 such that the seed cotton passes a plurality of ginning points. Each ginning point includes a slot 17 and a cooperative ginning roll 18. The finned member 16 may include a generally cylindrical hub 19 mounted for rotation about an axis indicated by shaft 21 and carrying a plurality of evenly spaced radially extending vanes or fins 22. Each pair of fins 22 form a trough therebetween wherein seed cotton is received from chute 11. As the finned member 16 rotates in the direction of arrow A, a sweep element 23 mounted to the chute 11 levels the seed cotton within the troughs. It will be noted that the proximity of the fins 22 to the surface 14 and the accumulation of cotton in the trough and chute 11 may prevent substantial airflow toward the slot 17. Therefore, the hub 19 is constructed to permit indirect airflow therefrom to enhance the airflow through slot 17.

FIGS. 2 and 3 illustrate two embodiments which could permit such airflow. In FIG. 2, a plurality of perforations 24 are formed in the hub 19 intermediate fins 22 to permit airflow and in FIG. 3 the hub 19 and vanes 22 are formed by a plurality of angle-shaped members 26 mounted in spaced relation to permit airflow therethrough. It may be seen that the sub-atmospheric pressure within chamber 13 will draw fibers from the seed cotton through the slot 17 into engagement with the ginning roll 18 which will carry the fiber to the nip point 20. However, only those fibers having sufficient length to extend through the slot to the nip point will have ginning force exerted on them. It will be seen that the moving ginning roll 18 will exert pressure on the seed cotton by pulling the fibers through the nip point 20, therefore causing the seed cotton to accumulate along the outside of slot 17; however the fins 22 are constantly moving at an appropriate speed to urge the seed cotton along a path defined by surface 14. Thus the seeds are urged along a first path by the finned member 16 while the lint or fiber engaged with ginning roll 18 is urged along a second path which diverges from the first. As the seed and fiber are urged along their separate paths, the forces generated by the finned member 16 and the ginning roll 18 remove the fiber from the seed.

With reference to FIGS. 2 and 3, it will be noted that each slot 17 is formed by a pair of slot walls **17*a* and 17*b*. The slot wall 17*a* which adjoins the nip point 20 is termed the downstream wall and is convex in shape whereas slot wall 17*b* is concave. The force of ginning will take place over the downstream wall 17*a* and therefore the convex shape minimizes the fiber stress, thus reducing undesirable fiber breakage. In the known state of the art ginning apparatus, the stationary knife edge which serves to separate the seed from the fiber has a very sharp front edge which necessitates the fiber being subjected to much greater stress and potential breakage. Thus, it may be seen that the present construction reduces fiber stresses; and therefore, fiber breakage as well as providing a means for discriminating against shorter fibers which do not extend into the nip point 20**.

Air drawn through slot 17 passes through the clearance between the ginning roll 18 and slot wall **17*b* and thus may be used to cool the surface of the ginning rolls 18. In the embodiment shown in FIG. 2, the ginning rolls 18 are members whose continuous surface contain fibrous material such as rubber impregnated with cotton fiber or walrus hide. However, the ginning rolls 18 may be formed as shown in FIG. 3 when the ginning roll 18 is discontinuous having a plurality of individually extending fibrous projections 18*a* which engage the fiber proximal the slot 17. In this embodiment, air is free to pass through slot 17 except when the slot 17 is obstructed by the projection 18*a***.

Figure 4:
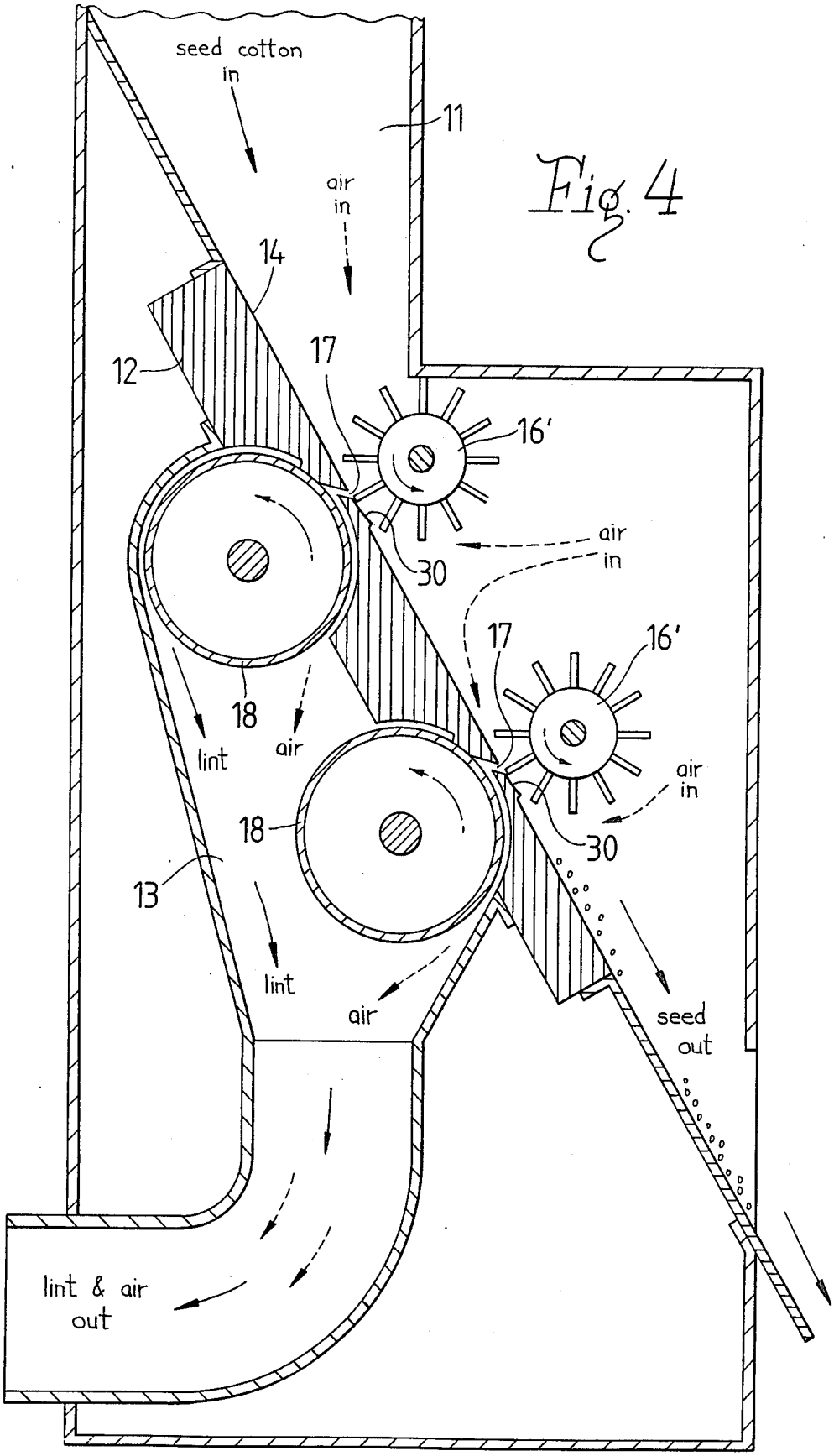
FIG. 4 is a sectional view of a second embodiment taken transversely of the axis of rotation of the multiple feed members.
Figure 5:
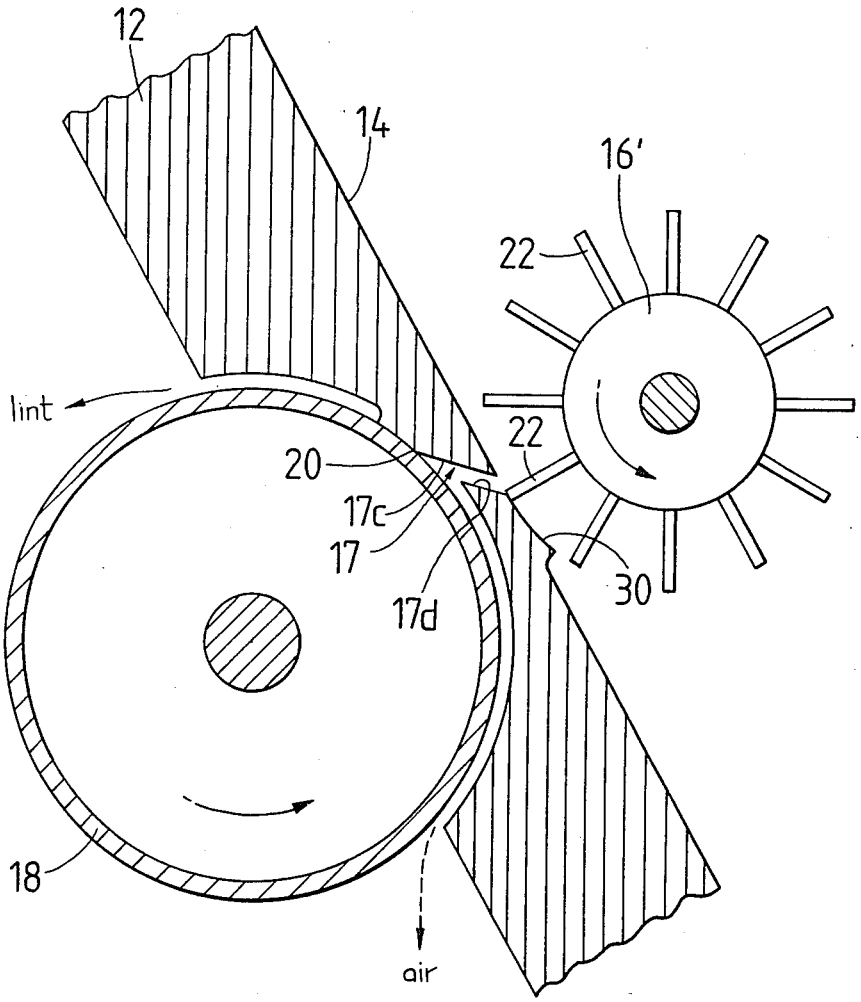
FIG. 5 is a partial sectional view showing the cooperation of the ginning roll, the slot, and the feed member in the embodiment of FIG. 4.

FIGS. 4 and 5 illustrate a second embodiment of my invention which enjoys certain advantages over the foregoing embodiment such as accessibility for adjustment and maintenance, and airflow through the slot 17 would not necessitate air passing through the finned members. With reference to FIG. 4, it may be seen that each slot 17 has associated therewith a finned rotary member 16' which may be similar in structure to the finned rotating members used in conventional roller ginning apparatus. The contour of the surface 14 does not encompass the periphery of the finned member 16, but rather is arcuate in a small region 30 downstream of the slot 17. The slots 17 in this embodiment are formed differently from the slots formed by slot walls **17*a* and 17*b*. In this embodiment, the slot walls 17*c* and 17*d* are generally straight sided and are formed at an acute angle relative to the upper part of surface 14. In this embodiment, the ginning roll 18 rotates counter-clockwise and engages the wall 12 adjoining the slot wall 17*c* whereas the finned member 16' urges the cotton seed downstream past slot wall 17*d*. Thus, the fiber and seed are urged along divergent paths which are nearly 180° apart, thereby minimizing the angular deflection of the fiber from the seed to the nip point 20**.

The arcuate region 30 of the surface 14 follows closely the path of a fin 22 for a predetermined distance then suddenly drops away, thereby releasing any seed with fiber still reaching the nip point 20 so that such seeds may be pulled back to the slot 17 where additional fiber may be grasped at the nip point before the next fin 22 moves the seed away from the slot 17. Thus, the fins 22 keep the seed accumulation cleared from the slot 17 but do not eject the seeds until they have been ginned to the desired degree. When multiple slots are used, the arcuate region 30 may be long at the first slot and shorter at successive slots to control the degree of ginning desired at each slot.

In operation for either embodiment, seed cotton is introduced to the apparatus via chute 11 whereupon it is engaged by the finned member 16 or 16'. The finned member 16 or 16' is driven about its axis at a rate selected to allow the seed cotton to remain proximal each slot 17 for sufficient time for the optimum removal of fiber from the seed. The actual removal of the fiber is accomplished through the interaction of the ginning roll 18 grasping the fiber at the nip point 20, thereby urging the fiber along a path defined by the rotation of the roll 18 and the fin 22 urging the seed away from the slot 17 along a path defined by the outer surface 14 of the wall 12. The fibers are brought into engagement with the ginning roll 18 by an air flow through the slot 17 induced by sub-atmospheric pressure within the chamber 13. When solid-type ginning rolls 18 are used, the air drawn through the slot serves the tri-fold purpose of conveying fibers through the slot, cooling the ginning roll and doffing the lint as it passes counter to the rotation of the roll. In all embodiments of the invention, the fibers are protected from excessive angular change of direction intermediate the seed and the nip point, and the seeds never come in contact with the ginning roll 18. It should be clear from the foregoing that the wall thickness and shape of the slot 17 are such that fibers drawn into the slot 17 by the air stream which have a length less than the distance from the outside of the slot 17 to the nip point 20 will not be removed from the seed; thus, providing a lint of a more uniform fiber length than heretofore attainable with a roller gin.

While I have shown my invention in two forms, it will be obvious to those skilled in the art that it is not so limited but is susceptible of various changes and modification without departing from the spirit thereof.

What I claim is:

1. Apparatus for ginning cotton comprising:

(a) at least one rotatable ginning roll;

(b) a housing surrounding said ginning roll including a wall of a predetermined minimum thickness having an inner surface cooperatively formed adjacent said ginning roll to create a nip point between said ginning roll and said inner surface with said nip point being adjacent a slot formed in said roll and extending longitudinally along said ginning roll with said slot having a depth and contour commensurate with a predetermined minimum length fiber in excess of the linter fiber on seed cotton;

(c) means for creating a sub-atmospheric pressure within said housing such that air moves through said slot into said housing; and (d) rotary means positioned outside of said housing adjacent said slot for urging seed cotton along the outer surface of said housing proximal said slot.

2. Apparatus as defined in claim 1 wherein said rotary means comprises a driven cylindrical member supporting a plurality of radially extending vanes forming longitudinal troughs about the periphery of said cylindrical member, with said vanes passing within a predetermined distance of said wall adjacent said slot.

3. Apparatus as defined in claim 2 wherein said wall has an outer surface cooperatively formed to semi-enclose said rotary means.

4. Apparatus as defined in claim 2 wherein said cylindrical member has a plurality of openings therein through which air may flow from the interior thereof.

5. Apparatus as defined in claim 2 wherein said wall has an arcuate outer surface adjacent the periphery of said rotary means.

6. Apparatus as defined in claim 1 wherein said slot has a convex surface extending from said nip point to the outside of said housing such that ginning stresses are reduced in said fibers.

7. Apparatus as defined in claim 1 wherein said ginning roll has a substantially continuous surface and is urged against said inner surface of said wall adjacent only one side of said slot such that air may be drawn over and through said slot.

8. Apparatus as defined in claim 1 wherein said ginning roll has a discontinuous surface urged against the inner surface of said housing adjacent said slot.

9. Apparatus as defined in claim 1 wherein said ginning roll and said rotary means rotate in the same angular direction and wherein said slot lies along a plane transverse to a line between the axis of said ginning roll and the axis of said rotary means such that fibers pulled from said seed cotton are not bent at an acute angle.

10. A process for ginning cotton having fiber greater than a minimum predetermined length corresponding to the linter length of fiber or seed cotton, comprising the steps of:

(a) urging seed cotton along a first predetermined path adjacent a stationary wall having a predetermined thickness in accordance with said minimum predetermined length;

(b) maintaining a sub-atmospheric pressure within a housing including said wall having a slot therein adjacent said first predetermined path to entrain fiber from said seed cotton in an airflow transverse to said predetermined path and through said slot in said wall; and (c) urging said fiber having a length greater than said predetermined length along a second predetermined path divergent from said first predetermined path and separated therefrom by said wall.

11. The process as defined in claim 10 wherein said first predetermined path is defined by a vaned rotary feed cylinder which urges said seed cotton along the outside of said housing adjacent said slot.

12. The process of claim 10 wherein said second predetermined path is defined by a rotating fibrous member mounted within said housing and urged against the inner surface thereof adjacent said slot to engage fibers drawn therethrough by said airflow.

13. The process as defined in claim 10 wherein said minimum predetermined length is defined by the minimum separation between said first predetermined path and said second predetermined path.

14. The process as defined in claim 13 wherein said minimum predetermined length is $\frac{1}{4}$ inch.

15. The process as defined in claim 10 wherein said first and second predetermined paths are arcuate about parallel axis and non-intersecting with said minimum predetermined length defined by the separation of said paths.

16. Apparatus for ginning cotton having fibers longer than a minimum predetermined length defined by the length of linter fiber or seed cotton, comprising:

(a) first means for urging seed cotton along a predetermined path adjacent a stationary wall;

(b) second means for urging fiber having a length in excess of said minimum predetermined length along a predetermined path diverging from said first predetermined path and separated therefrom by said wall such that said fibers are separated from said cotton seed;

(c) a housing surrounding said second means for urging said fiber including said wall and having a slot formed in said wall transversely of and intermediate said paths; and (d) means for creating a sub-atmospheric pressure within said housing such that an airflow through said slot entrains fiber from said seed cotton thereinto.

17. Apparatus as defined in claim 16 wherein said wall has a thickness commensurate with said minimum predetermined length.

* * * * *

UNITED STATES PATENT AND TRADEMARK OFFICE

CERTIFICATE OF CORRECTION

PATENT NO. : 4,779,309

DATED : October 25, 1988

INVENTOR(S) : Donald W. Van Doorn

It is certified that error appears in the above—identified patent and that said Letters Patent is hereby corrected as shown below:

Claim 10, line 3 after "fiber", "or" should be - on -.

Claim 16, line 3 after "fiber", "or" should be - on -.

Signed and Sealed this

Ninth Day of May, 1989

*Attest:*

DONALD J. QUIGG

*Attesting Officer*

*Commissioner of Patents and Trademarks*